US007217202B2

(12) United States Patent
Troxell

(10) Patent No.: US 7,217,202 B2
(45) Date of Patent: May 15, 2007

(54) DEVICE FOR TEACHING SOFTBALL OR BASEBALL PITCHING TECHNIQUE

(76) Inventor: April Troxell, 14322 E. 36 St., Tulsa, OK (US) 74134

( * ) Notice: Subject to any disclaimer, the term of this patent is extended or adjusted under 35 U.S.C. 154(b) by 94 days.

(21) Appl. No.: 11/071,722

(22) Filed: Mar. 3, 2005

(65) Prior Publication Data

US 2006/0199677 A1 Sep. 7, 2006

(51) Int. Cl.
*A63B 69/00* (2006.01)

(52) U.S. Cl. ..... 473/451; 473/422; 473/428

(58) Field of Classification Search ..... 473/422, 473/417, 426–431, 451, 453
See application file for complete search history.

(56) References Cited

U.S. PATENT DOCUMENTS 1,881,384 A * 10/1932 Albera ..... 473/428
2,985,452 A * 5/1961 Trippet ..... 473/453
3,937,464 A * 2/1976 Zalewski ..... 473/428
4,486,020 A 12/1984 Kane et al.
4,846,471 A 7/1989 Haysom
5,322,276 A * 6/1994 Hardison, Jr. ..... 473/417
5,348,291 A 9/1994 Scully
5,439,214 A 8/1995 Dalbo
5,439,225 A 8/1995 Gvoich et al.
5,441,255 A * 8/1995 Verbick ..... 473/55
5,518,480 A 5/1996 Frappier
5,713,805 A 2/1998 Scher et al.
6,651,497 B2 11/2003 Imatoh
6,666,781 B1 * 12/2003 Illis ..... 473/453

* cited by examiner

*Primary Examiner*—Mitra Aryanpour
(74) *Attorney, Agent, or Firm*—Molly D. McKay

(57) ABSTRACT

A free standing, portable device for teaching pitching technique for softball or baseball. The device consists of a folding h-shaped base that rests on the ground and supports a removable vertical member. A horizontal track member is removably secured to the vertical member and can be adjusted in height on the vertical member to match the height of the pitcher. A ball attaches to the horizontal track member and can travel along the horizontal track member as the pitcher executes a pitch while grasping the ball. The ball is mounted to the horizontal track in such a way that the ball is free to spin in either direction relative to the horizontal track. In an alternate embodiment, an optional curved track can replace the horizontal track member in order to facilitate teaching additional pitching techniques.

6 Claims, 5 Drawing Sheets

DEVICE FOR TEACHING SOFTBALL OR BASEBALL PITCHING TECHNIQUE

BACKGROUND OF THE INVENTION

1. Field of the Invention

The present invention relates to a free standing device that can be used to teach a person various techniques for pitching a softball or baseball. More specifically, the present invention is a device having a vertical member that has a base that rests on the ground beside the pitcher. A horizontal track member is supported on the vertical member, and the horizontal track member can be adjusted in height to match the height of the pitcher. A ball is movable mounted on the horizontal track member. The ball is mounted on the horizontal track member in such a way as to allow the ball to spin in either direction relative to the horizontal track member as it travels along the track member. A curved track can optionally be used on the device as a replacement for the horizontal track member in order to facilitate teaching additional pitching techniques.

2. Description of the Related Art

It is difficult to teach a person techniques for pitching a softball or baseball without some way of physically guiding them through the arm and hand movements required to accomplish the pitch. Specifically, the hardest thing to teach a pitcher is the pressure to exert on the ball and the tight spin to exert on the ball to successfully execute a particular type of pitch or pitching technique, i.e. a knuckle ball, a curve ball, a fast ball, a drop ball, a rise ball, etc. In the past, people have attempted to teach pitching techniques by providing an example of how the pitch is accomplished and then having the person who is to learn the pitching technique to try to imitate the movements they have observed being performed by the other person. This type of teaching system does not provide the consistency and repeatability that is desired for effective teaching of pitching technique. Another way of teach pitching techniques is to simply provide verbal instructions on how the arms and hands should move to achieve the various types of pitches. This method also presents problems with consistency and repeatability. Another method of teaching is to have the instructor and the pupil both grasp the same ball and have the pupil move through the same motions as produced by the instructor. However, this is cumbersome and difficult for the teacher to achieve the proper range of motion with the pupil's arm and hand in the way.

A more effective means of teaching a pitching technique is to have some type of device that allows the pitcher to repeat the desired arm and hand movements until the pitcher has mastered the pitching techniques. Devices have been proposed for use in teaching pitching technique that include a ball that is on a rope or is otherwise tethered so as to limit the range of motion of the ball as the pitcher practices his or her pitching. Although these types of devices might be useful in teaching one type of pitch, they are not versatile enough to teach the proper arm and hand movements necessary for different types of pitches.

The present invention addresses this need by providing a physical guide for a pitched ball that allows a pitcher to consistently and repeatedly perform the required arm and hand movements to properly complete various types of pitches. Specifically, the present invention isolates the muscles to require the pitcher to exert the most pressure and the tightest spin on the ball for a particular type of pitch. This device can be used to teach various pitching techniques for either softballs or baseballs.

The present device is portable and can be quickly and easily assembled for use or alternately, disassembled for transport or storage. It has a folding base that detaches from a vertical member of the device and a horizontal track member that detaches from the vertical member so that the pieces of the device can be disassembled and placed in a box for transport or storage. Also, the device is adjustable so that it can be adjusted vertically to accommodate pitchers of different heights. The present device's base allows the vertical member of the device to be positioned in a self-supporting, upright manner beside a pitcher as the pitcher practices various pitching techniques. The device is provided with a ball that is attached to the horizontal track member supported on the device by the vertical member. The ball is grasped by the pitcher in order to practice pitching. When practicing various pitching techniques using the present invention, the ball always remains attached to the device and the pitcher can judge by the movement of the ball whether he or she has performed the proper arm and hand movements by observing the spin produced in the ball as the ball is released from the pitcher's hand. The ball is mounted to the horizontal track in such a way that the ball is free to spin in either direction relative to the horizontal track, thereby allowing the pitcher to simulate the spin effect that his or her movements would produce in a ball. The device is provided with an optional curved track that can be used on the device as a replacement for the horizontal track member in order to facilitate teaching additional pitching techniques beyond those possible with use of the horizontal track member.

SUMMARY OF THE INVENTION

The present invention is a device for teaching pitching technique for softball or baseball. The device consists of an h-shaped base that rests on the ground and supports a vertical member. A horizontal track member is removably secured to the vertical member and can be adjusted in height on the vertical member to match the height of the pitcher who will use the device. The device is provided with a ball that is attached to the horizontal track member and travels along the horizontal track member as the pitcher executes a pitch while grasping the ball. The ball is mounted to the horizontal track in such a way that the ball is free to spin in either direction relative to the horizontal track, thereby allowing the pitcher to simulate the spin effect that his or her movements would produce in a ball. The device is provided with an optional curved track that can be used on the device as a replacement for the horizontal track member in order to facilitate teaching additional pitching techniques beyond those possible with use of the horizontal track member.

DETAILED DESCRIPTION OF THE PREFERRED EMBODIMENT

The Invention

Figure 2:
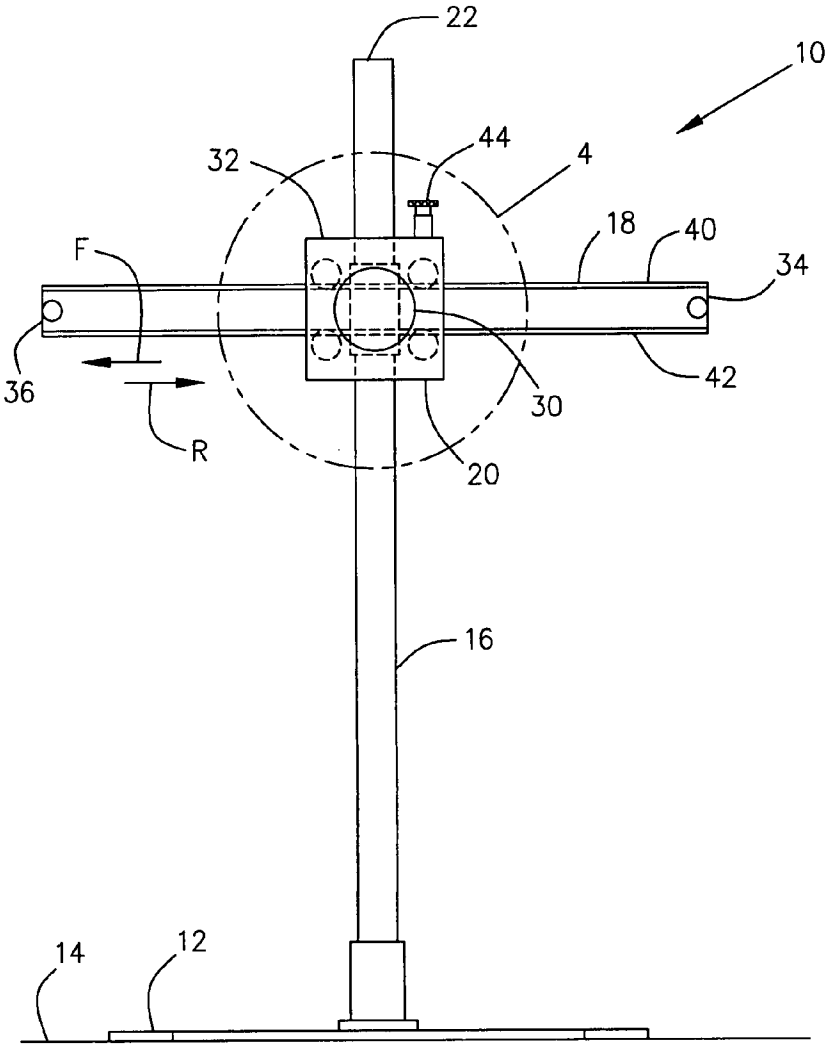
FIG. 2 is a side view of the device of FIG. 1.
Figure 1:
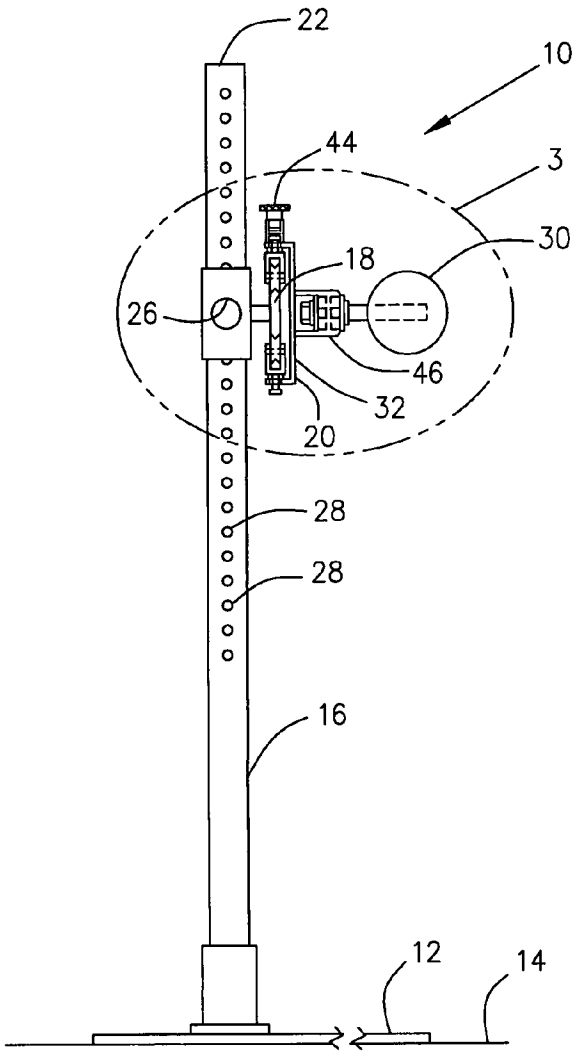
FIG. 1 is a front view of a device for teaching softball or baseball pitching technique constructed in accordance with a preferred embodiment of the present invention.
Figure 5:
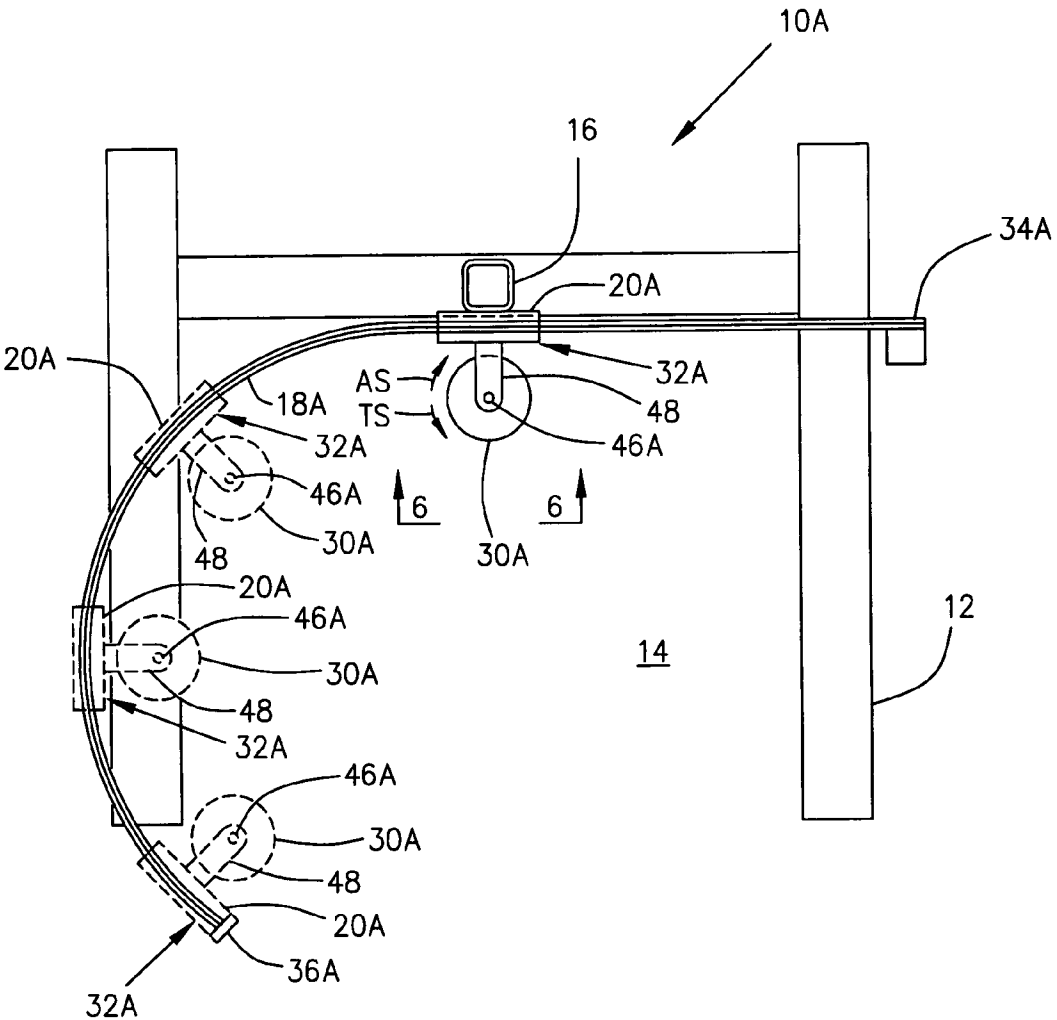
FIG. 5 is a top plan view of an alternate device that is similar to the device of FIG. 1 but with the horizontal track member removed and replaced by an optional curved track. Several alternate ball positions are illustrated in FIG. 5 to show the movement of the ball along the curved track.

Referring now to the drawings and initially to FIGS. 1 and 2, there is illustrated a device for teaching pitching technique for softball or baseball 10 constructed in accordance with a preferred embodiment of the present invention. The device 10 consists of an h-shaped base 12 that rests on the ground 14 and supports a vertical member 16. The h-shaped base 12 is best viewed from the top, as illustrated in FIG. 5.

Referring back to FIGS. 1 and 2, a horizontal track member 18 is removably secured to the vertical member 16 via a sleeve 20 provided on the horizontal track member 18 that slides over a top end 22 of the vertical member 16 so that the vertical member 16 is received within the sleeve 20. A locking means 24 secures the horizontal track member 18 to the vertical member 16.

The horizontal track member 18 can be adjusted in height to match the height of a pitcher who will use the device 10. In order to adjust the height of the horizontal track member 18, the locking means 24 is first removed. Then the horizontal track member 18 is placed at the desired height on the vertical member 16. The locking means 20 is then inserted consecutively through a sleeve opening 26 provided in the sleeve 20 of the horizontal track member 18 and then through one of a plurality of height adjustment openings 28 provided along the length of the vertical member 16 that aligns with the sleeve opening 26. Once the locking means 24 is inserted into the aligned openings 28 and 26, the horizontal track member 18 is secured at the desired height on the vertical member 16.

The device 10 is provided with a ball 30 that is attached to the horizontal track member via a ball glide assembly 32 which allows the ball 30 to travel along the horizontal track member 18 as the pitcher executes a pitch while grasping the ball 30. The ball glide assembly 32 movably mounts the ball 30 on the horizontal track member 18 in such a way that the ball 30 is free to move forward and rearward along the horizontal track member 18, as indicated respectively in FIGS. 2 and 4 by Arrows F and R, and to spin in either a forward direction or a rearward direction relative to the horizontal track member 18, as indicated respectively in FIG. 4 by Arrows FS and RS, thereby allowing the pitcher to simulate the spin effect that his or her movements would produce in a normal softball or baseball (not illustrated).

Figure 3:
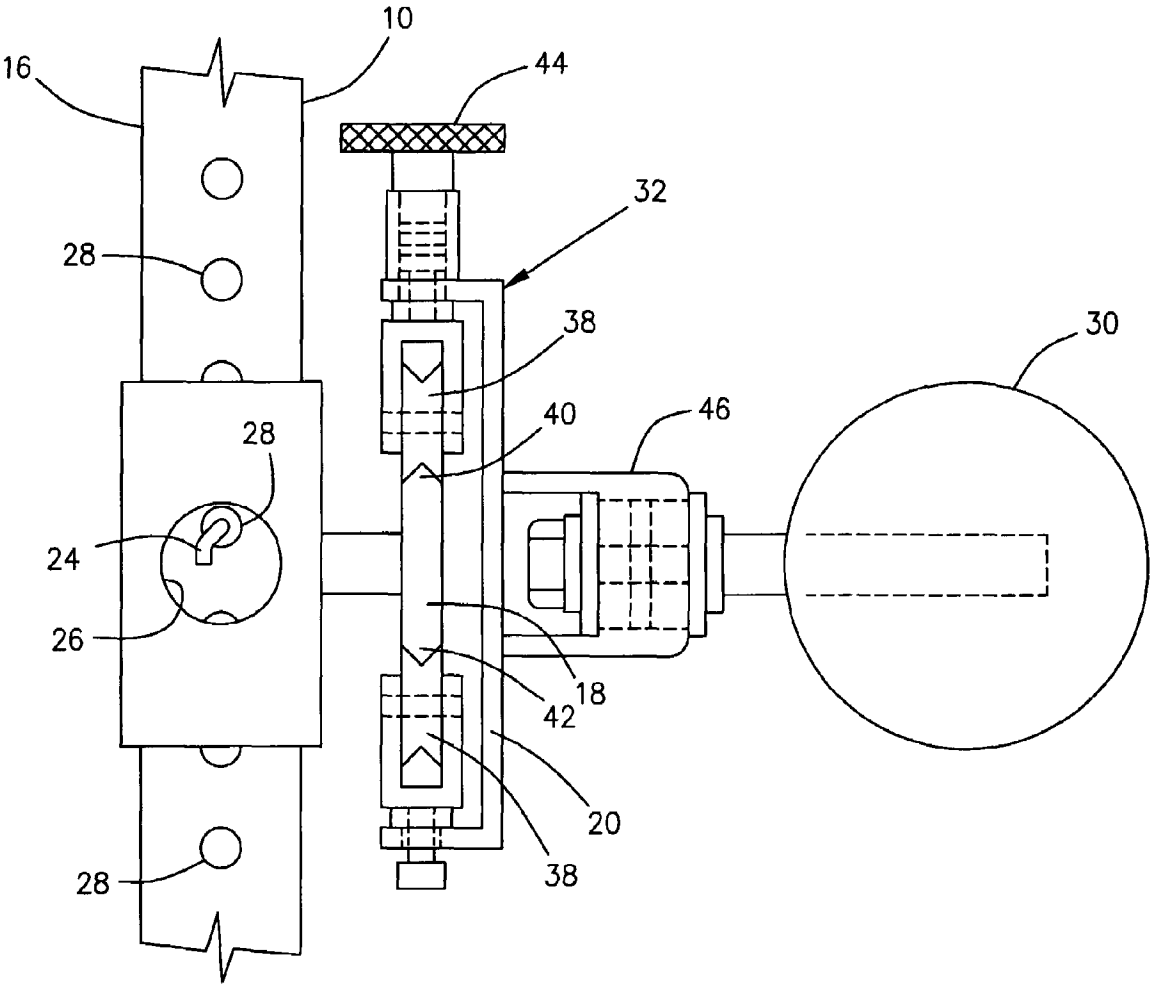
FIG. 3 is an enlarged view of the area within circle 3 of FIG. 1.
Figure 4:
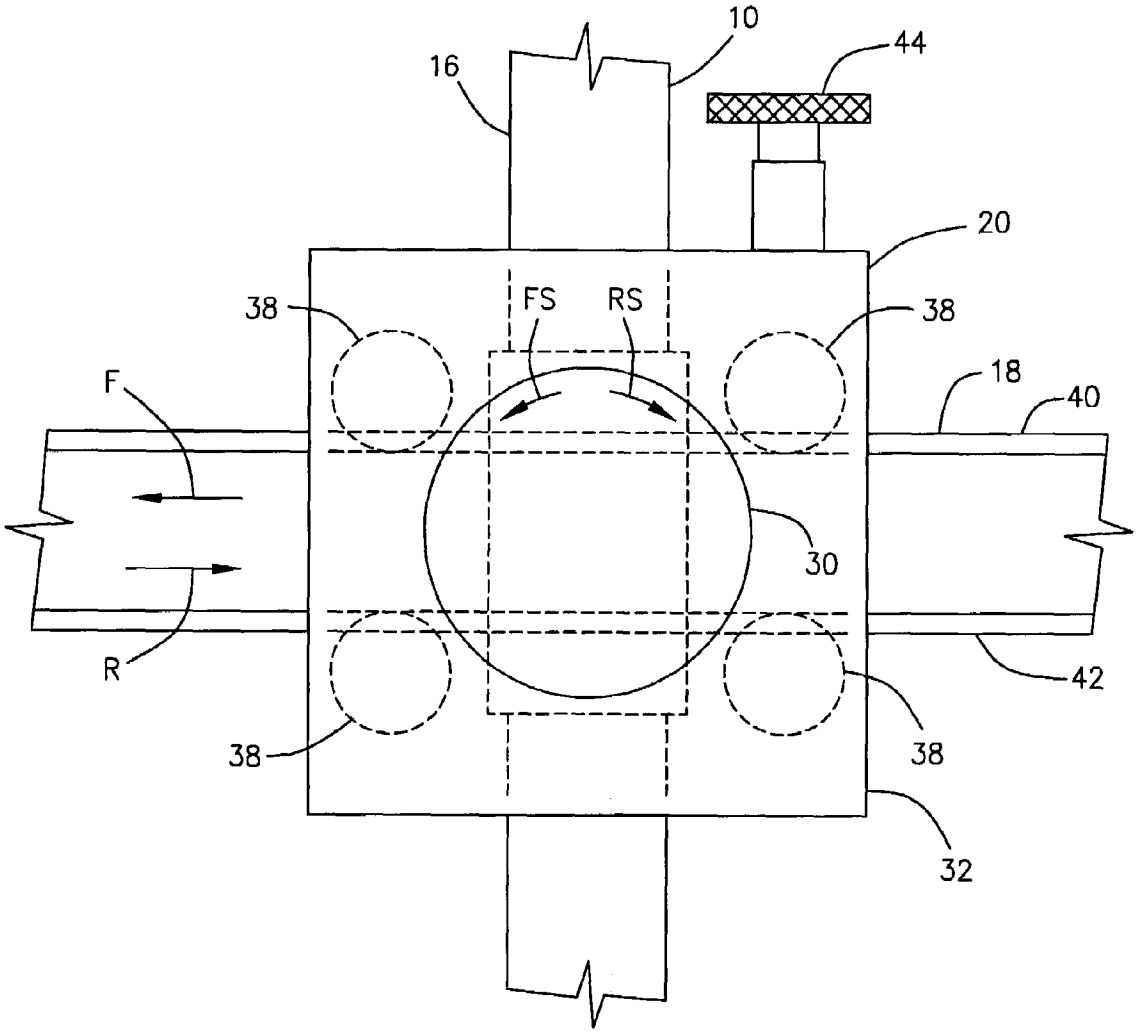
FIG. 4 is an enlarged view of the area within circle 4 of FIG. 2.

Referring to FIGS. 2, 3 and 4, the ball glide assembly 32 slips onto one of the ends 34 or 36 of the horizontal track member 18 so that v-rollers 38 provided on the ball glide assemble 32 engage a v-shaped top 40 and a v-shaped bottom 42 of the horizontal track member 18, thereby holding the ball glide assembly 32 in gliding engagement with the horizontal track member 18. A drag adjustment knob 44 is provided on the ball glide assembly 32 as a means of adjusting the tension on the ball glide assembly 32 in its gliding engagement with the horizontal track member 18. The drag adjustment knob 44 can be adjusted to retard or to totally stop forward and backward motion of the ball glide assembly 32 on the horizontal track member 18, thereby forcing the pitcher to concentrate his or her efforts on exerting maximum spin on the ball 30 as the pitcher practices various pitching techniques.

The ball 30 attaches to the ball glide assembly 32 via a ball rotation bearing assembly 46 that allows the ball 30 to extend outward horizontally toward the pitcher and allows the ball 30 to rotate or spin in the forward direction of arrow FS and in the rearward direction of arrow RS as previously described in association with FIG. 4.

Figure 6:
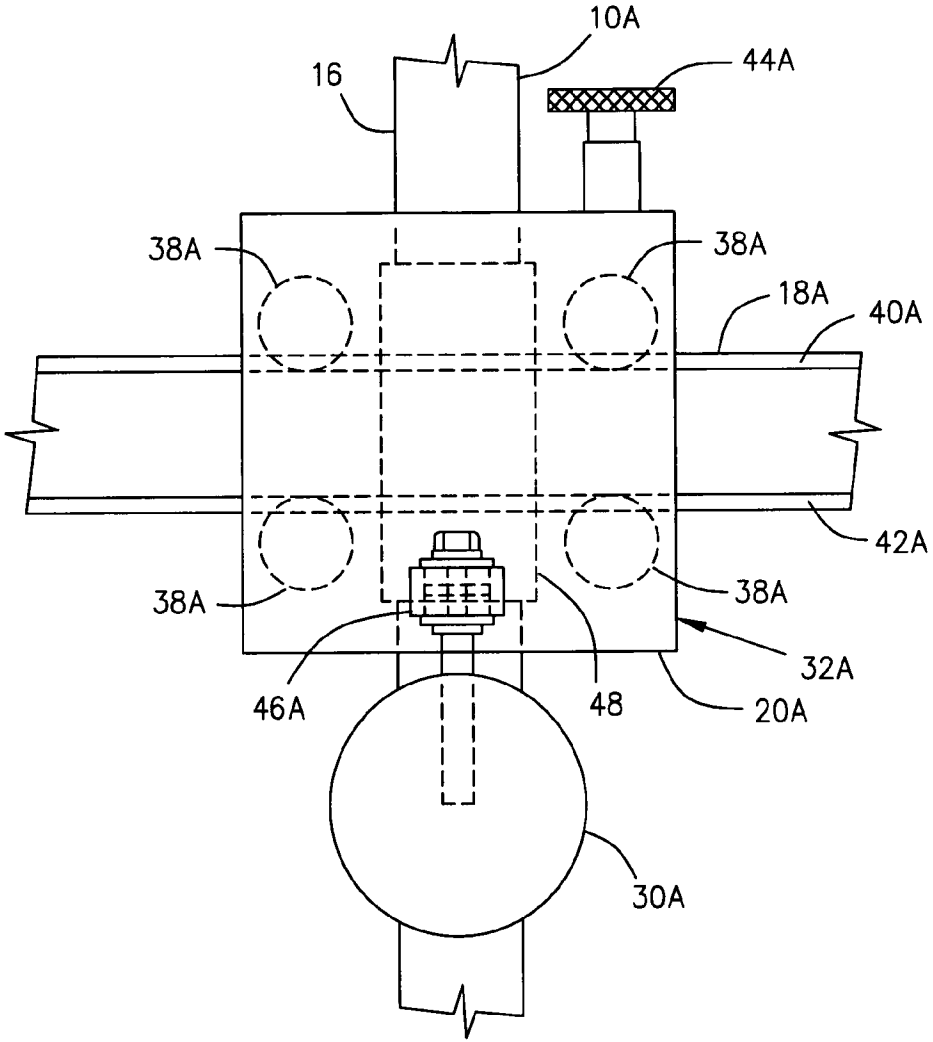
FIG. 6 is a side view of the alternate device of FIG. 5 taken along line 6—6.

As illustrated in FIGS. 5 and 6, an alternate embodiment device 10A can be created by using an optional curved track 18A as a replacement for the horizontal track member 18. This alternate embodiment device 10A facilitates teaching an additional pitching technique, specifically the teaching of a curve ball technique, beyond those techniques that are possible to teach with use of the device 10 and its associated horizontal track member 18. The curve track 18A is provided with an alternate v-shaped top 40A that is similar to the v-shaped top 40 and an alternate v-shaped bottom 42A that is similar to the v-shaped bottom 42. The curved track 18A is curved in configuration at its front end 36A and is straight at its rear end 34A instead of being straight on both ends 36 and 34 like the horizontal track member 18.

As illustrated in FIGS. 5 and 6, an alternate ball glide assembly 32A is employed with the curved track 18A. This alternate ball glide assembly 32A is provided with an alternate sleeve 20A that is similar to sleeve 20, alternate v-rollers 38A that are similar to v-roller 38, and an alternate drag adjustment knob 44A that is that is similar to drag adjustment knob 44. Referring to FIG. 5, the alternate ball glide assembly 32A differs from the ball glide assembly 32 in that the alternate ball glide assembly 32A is provided with an arm 48 that extends outward vertically from the alternate ball glide assembly 32A and extends toward the pitcher. An alternate ball rotation bearing assembly 46A is provided on the arm 48. An alternate ball 30A attaches to the alternate ball glide assembly 32A via the alternate ball rotation bearing assembly 46A so that the alternate ball 30A extend downward vertically from the alternated ball glide assembly 32A and allows the alternate ball 30A to rotate or spin in the direction toward the pitcher, as shown by Arrow TS in FIG. 5 and in the direction away from the pitcher, as shown by Arrow AS in FIG. 5.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A device for teaching pitching technique for softball or baseball comprising:

a base, a vertical member removably attached to and supported by the base, a track member removably secured to and supported horizontally by the vertical member, a ball movably attached to the track member so that the ball can travel parallel to the track member, and a ball rotation bearing assembly rotationally attaching the ball to the track member so that the ball can spin in two alternate directions relative to the track member.

2. A device for teaching pitching technique for softball or baseball according to claim 1 further comprising:

means for adjusting the height of the track member on the vertical member.

3. A device for teaching pitching technique for softball or baseball according to claim 1 further comprising:

a ball glide assembly movably attaching the ball to said track member, rollers provided on the ball glide assembly that movably engage the track member so that said ball can travel parallel to the track member.

4. A device for teaching pitching technique for softball or baseball comprising:

a base, a vertical member removably attached to and supported by the base, a track member removably secured to and supported horizontally by the vertical member, a ball movably attached to the track member so that the ball can travel parallel to the track member, rotating means attaching the ball to the track member so that the ball can spin in two alternate directions relative to the track member, a ball glide assembly movably attaching the ball to said track member, rollers provided on the ball glide assembly that movably engage the track member so that said ball can travel parallel to the track member, and the rotating means provided with a ball rotation bearing assembly rotationally securing the ball to the ball glide assembly so that the ball can spin in two alternate directions relative to the track member.

5. A device for teaching pitching technique for softball or baseball comprising:

a folding h-shaped base that rests on the ground, a vertical member removably attached to and supported by the base, a horizontal track member removably secured to and supported by the vertical member, means for adjusting the height of the horizontal track member on the vertical member, a ball attached to the horizontal track member via a ball glide assembly, rollers provided on the ball glide assembly that movably engage the horizontal track member so that the ball can travel parallel to the horizontal track member, and a ball rotation bearing assembly provided on the ball glide assembly so that the ball can spin in one of two directions relative to the horizontal track member.

6. A device for teaching pitching technique for softball or baseball comprising:

a folding h-shaped base that rests on the ground, a vertical member removably attached to and supported by the base, a curved track member removably secured to and supported by the vertical member, means for adjusting the height of the curved track member on the vertical member, a ball attached to the curved track member via a ball glide assembly, rollers provided on the ball glide assembly that movably engage the curved track member so that the ball can travel parallel to the curved track member, and a ball rotation bearing assembly provided on the ball glide assembly so that the ball can spin in one of two directions relative to the horizontal track member.

* * * * *